US005205230A

United States Patent [19]

Jiminez et al.

[11] Patent Number: 5,205,230

[45] Date of Patent: Apr. 27, 1993

[54] SEWING MACHINE

[75] Inventors: Antonio Jiminez, Meyrin, Switzerland; Patrice Deplante, Annemasse, France; Michel Combepine, Les Avanchets, Switzerland

[73] Assignee: Mefina S. A., Switzerland

[21] Appl. No.: 798,929

[22] Filed: Nov. 29, 1991

[30] Foreign Application Priority Data

Nov. 29, 1990 [CH] Switzerland ..... 3781/90

[51] Int. Cl.[5] ..... D05B 69/10; D05B 73/04

[52] U.S. Cl. ..... 112/220; 112/258

[58] Field of Search ..... 112/220, 258, 259, 260

[56] References Cited

U.S. PATENT DOCUMENTS

| | | | |
|---|---|---|---|
| 2,709,978 | 6/1955 | Adler . | |
| 3,012,532 | 12/1961 | Leslie . | |
| 4,183,310 | 1/1980 | Johnson | 112/258 X |
| 4,193,361 | 3/1980 | Johnson . | |
| 4,552,081 | 11/1985 | Vartoukian et al. | 112/258 |
| 5,018,467 | 5/1991 | Jiminez et al. | 112/315 |

FOREIGN PATENT DOCUMENTS

| | | |
|---|---|---|
| 0337952 | 4/1989 | European Pat. Off. . |
| 0377403 | 7/1990 | European Pat. Off. . |
| 0378965 | 7/1990 | European Pat. Off. . |
| 0817837 | 8/1951 | Fed. Rep. of Germany . |
| 1082485 | 12/1955 | Fed. Rep. of Germany . |
| 2421683 | 11/1974 | Fed. Rep. of Germany . |
| 3111812 | 10/1986 | Fed. Rep. of Germany . |
| 3545530 | 10/1987 | Fed. Rep. of Germany . |
| 3812725 | 2/1989 | Fed. Rep. of Germany . |
| 9118139 | 11/1991 | PCT Int'l Appl. . |
| 675600 | 10/1990 | Switzerland . |
| 0855405 | 11/1960 | United Kingdom . |
| 2175616 | 4/1985 | United Kingdom . |

*Primary Examiner*—Andrew M. Falik
*Assistant Examiner*—Paul C. Lewis
*Attorney, Agent, or Firm*—Cushman, Darby & Cushman

[57] ABSTRACT

In this sewing machine, in which the amplitude and direction of the feeding of the fabric to be sewn are controlled by an electric motor slaved to an electronic pilot-control circuit, the bobbin (16), its drive mechanism (17, 19, 10) and the drive mechanism (4*–17*) for feeding the fabric to be sewn are mounted on an intermediate support (6) that is solid with the body of the motor (11), which is attached to the frame (2) of the machine by a sleeve (23) engaging the inside of the lower arm of the frame.

4 Claims, 2 Drawing Sheets

SEWING MACHINE

The present invention relates to sewing machines that include a frame with two arms, associated with which arms are at least, for the first arm a needle bar and its drive mechanism, and for the second arm, a loop-taker, its drive device, and a drive mechanism for feeding the fabric to be sewn.

More particularly, its subject is a machine of this type, in which the amplitude and direction of the feeding of the material to be sewn are controlled by an electric motor slaved to an electronic pilot-control circuit.

Some of these machines include a monolithic frame made of injection molded cast iron, to which the various components listed above must be attached individually and then must each undergo the requisite adjustments, within the context of the technical assembly they belong to.

It will be appreciated that the manufacture and assembly of such machines entails labor and requires complicated and hence expensive equipment.

The applicant has sought to find technological ways by which the above disadvantages can be limited or even overcome, while the quality of its products is preserved or even improved.

In particular, it has proposed a novel architecture of the internal skeleton of a sewing machine and its frame (see Swiss Patent 675 600, in particular); a more rational construction of the needle bar drive mechanism with respect to both its axial displacements and its casting movements (see European Patent Document 0 377 403), all in the form of an autonomous unit that can be assembled and set independently of the final assembly of the machine; and an unprecedented architecture of the presser foot and the devices controlling it, likewise constituting an autonomous unit having advantages similar to those of the novel needle bar drive mechanism (see European Patent Document 0 378 965).

In the aforementioned Swiss patent, the strong skeleton is tubular in form and is constituted by joining two shells, made by stamping; a motor shaft and its bearings are integrated between the shells. This last possibility has proven particularly advantageous, especially to make a unit in which the shaft and its bearings are the ones intended to control the needle bar of the sewing machine, and hence are elements that are associated with the skeleton, and more particularly with the upper arm of the skeleton, as soon as it is manufactured.

The applicant now seeks to improve the rationalization of the manufacture and assembly of the elements and devices traditionally associated with the lower arm of a sewing machine of the type described above, which nevertheless is characterized in that the loop-taker, its drive device and the drive mechanism for feeding the fabric to be sewn are mounted on an intermediate support, and in that it includes means for fixing this support to the body of the motor, and means for fixing the body of the motor to the second arm of the frame.

The accompanying drawings schematically show an exemplary embodiment thereof.

Figure 1:
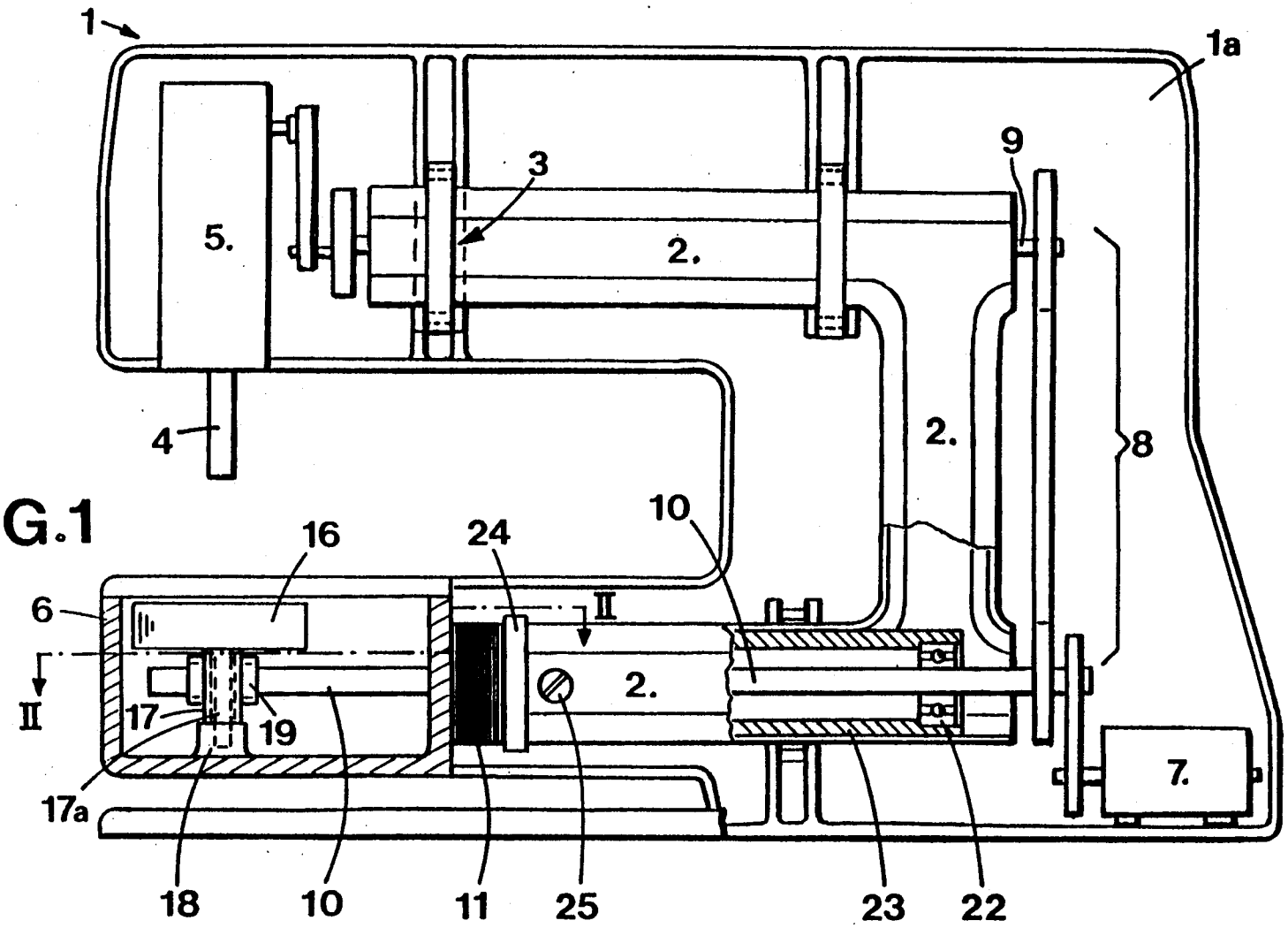
FIG. 1 is a front view, in section, of some of its elements.

The sewing machine that can be seen in FIG. 1 has a housing 1, formed by joining together two shells, such as the shell 1*a*, which moreover constitutes one of the two elements of the frame of the machine, of the type described and shown in the aforementioned Swiss Patent 675 600.

Such a frame is in fact constituted by this shell 1*a* and by a strong U-shaped skeleton 2, which is formed in the present case by a tubular body of hexagonal cross section, fixed removably on this shell by three devices, generally identified by reference numeral 3, the structural details of which are in particular the subject of International Application PCT/CH91/OC119, filed on May 17, 1991.

Figure 2:
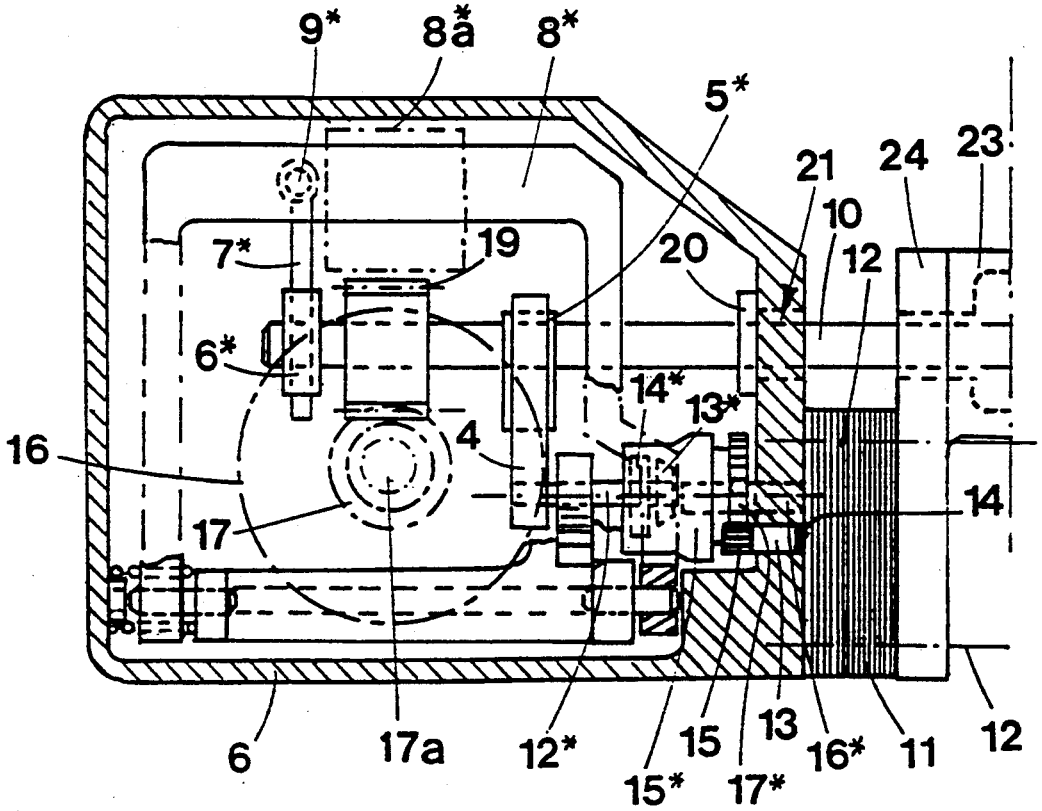
FIG. 2 is a section on a larger scale, taken along the line II—II of FIG. 1.

In the usual manner, this sewing machine includes a needle bar 4, a mechanism 5 for controlling the needle bar, a drive mechanism for feeding the material to be sewn, and a loop-taker, the structural details of which are shown schematically in FIG. 2, and which are essentially disposed in a housing 6.

The aforementioned devices are driven in the traditional manner by a motor 7, via a set of pulleys and belts, identified generally by reference numeral 8, which drive two motor shafts 9 and 10, respectively, which in the case of the shaft 9 pass through the upper arm of the skeleton 2 and in the case of the shaft 10 pass through the lower arm of the skeleton 2. Pivoting of the shaft 9 in the upper arm of the skeleton and holding it in a centered, horizontal position are assured by two ball bearings mounted inside this arm, for example in the manner described in Swiss Patent 675 600, to which reference may be made for further details.

The shaft 10, in turn, is mounted in the lower arm of the skeleton 2, in the manner to be described hereinafter.

The sewing machine shown in FIG. 1 is of the type in which the amplitude and direction of the feeding of the material to be sewn are controlled by an electric motor, in particular a stepping motor, slaved to an electronic pilot-control circuit. This technique is well known to one skilled in the art, because it has already been employed for a number of years.

The stepping motor 11 carries the housing 6, which is attached to the motor by a series of screws, for example, of which only the shanks 12 can be seen in the drawing (FIG. 2).

The motor includes a shaft 13 that extends through a passage 14 in the housing 6, and on the end of which a pinion 15 meshing with a toothed ring 17*, formed on the periphery of the first movable element 15* of a device for controlling the amplitude and direction of movement imparted to a dog 8*a** for feeding the material to be sewn, has been cut.

The various elements of this device are indicated by reference numerals marked with an asterisk (*); their specific structure and the functional assembly to which they belong are described in U.S. Pat. No. 5,018,467 to which reference may be made for further details. In this patent, elements similar to those shown in FIG. 2 are identified by the same reference numerals, without the asterisk.

In addition to the above elements, the housing 6 includes in particular a rotary hook 16 mounted on the upper end of a pinion 17 that rotates on a shaft 17*a*, which is sketched in dashed lines and is solid, at 18, with the bottom of the housing 6. The pinion 17 meshes with a second pinion 19 that is solid with the shaft 10 (FIG. 2), on which the drive of the hoc k 16 depends.

At this point it is appropriate to note that the shaft 10 rotates in two bearings: a first, smooth bearing 20 engaging a passage 21 made in the wall of the housing 6 (FIG. 2), and a second, ball bearing 22, wedged into the opening of the right-hand end of a sleeve 23, the left-hand end of which .s solid with a flange 24 (FIG. 1).

This sleeve 23 is attached to the motor 11 via this flange and via the screws already mentioned, only the longitudinal shanks 12 of which are shown.

In the embodiment shown, the arms of the skeleton 2, in particular, are tubular and have a hexagonal cross section Advantageously, the external profile of the sleeve 23 is selected such that it can easily be introduced into the lower arm of the skeleton 2 by simple sliding. It can be blocked in the fully engaged position in the skeleton by a screw 25 that passes through an opening made in the wall of the skeleton and takes hold in a threaded hole provided in the body of the sleeve 23.

In a variant, this opening may be in the form of a slot extending parallel to the longitudinal axis of the lower arm of the skeleton 2, thus making it possible to fix the sleeve 23 in a more or less engaged position in the skeleton; if so, it is then possible to displace the hook 16 laterally with respect to the needle, not shown, that the needle bar 4 bears, in particular to make adjustments that may be needed.

The invention described makes it possible within a very wide range to rationalize the manufacture and assembly of the structural devices traditionally located in the lower arm of a sewing machine; in particular, the manufacture and assembly of the set including the housing 6 and the devices it contains, along with the motor 11 and the sleeve 23 can be provided independently of the rest of the sewing machine, the entirety constituting an autonomous unit that can easily be attached to the strong skeleton of the machine in the manner described above.

In return, such a unit can if needed be removed just as easily, especially in order to replace it with a similar unit should it become defective.

We claim:

1. A sewing machine, having a frame with a first and a second arm said first arm including a needle bar and a needle bar drive mechanism, and said second arm including a loop-taker, a loop-taker drive mechanism, and a drive mechanism for feeding a material to be sewn, said drive mechanism including an electric motor slaved to an electronic pilot-controlled circuit for controlling the amplitude and direction of the feeding of the material to be sewn, characterized in that the loop-taker and the drive mechanism for feeding the material are mounted on an intermediate support, and said sewing machine further includes means for fixing said intermediate support to the body of the electric motor and means for fixing the body of the electric motor to the second arm of the frame.

2. The sewing machine of claim 1, wherein the second arm of the frame has a tubular structure, the loop-taker drive device includes at least one rotary shaft extending inside the second arm and mounted to rotate in at least two bearings, the means for fixing the body of the electric motor to the second arm include at least one sleeve slidingly engaging the opening of the second arm through which said rotary shaft passes, first devices for fixing said sleeve to the body of the electric motor, and second devices for fixing said sleeve to the second arm; and said bearings are solid with said intermediated support, in the case of one bearing, and with said sleeve, in the case of the other.

3. The sewing machine of claim 1, wherein said intermediate support, the loop-taker, the loop-taker drive device, the drive mechanism for feeding the material to be sewn, said electric motor, the sleeve, and said fixation means form an autonomous and removable unit.

4. The sewing machine of claim 2, wherein said intermediate support, the loop-taker, the loop-taker drive device, the drive mechanism for feeding the material to be sewn, said electric motor, the sleeve, and said fixation means form an autonomous and removable unit.

* * * * *